US005609282A

United States Patent [19]

Melanson

[11] Patent Number: 5,609,282

[45] Date of Patent: Mar. 11, 1997

[54] BELT-MOUNTED RECEPTACLES AND TOTE TRAY THEREFOR

[76] Inventor: Charles J. Melanson, 1025 Staghorn St., West Palm Beach, Fla. 33414

[21] Appl. No.: 489,590

[22] Filed: Jun. 12, 1995

[51] Int. Cl.[6] ..... A45F 4/00; A45F 5/00

[52] U.S. Cl. ..... 224/576; 224/583; 224/669; 224/666; 224/679; 224/904; 294/159; 294/141; 220/23.83; 206/338; 206/373

[58] Field of Search ..... 224/678, 583, 224/581, 904, 669, 576, 679, 666; 294/159, 160, 161, 146, 143; 206/565, 560, 203, 338, 372, 373; 220/23.83, 23.86

[56] References Cited

U.S. PATENT DOCUMENTS

| | | | |
|---|---|---|---|
| 768,364 | 8/1904 | Hines | 220/23.83 |
| 2,278,401 | 3/1942 | Micari | 224/678 |
| 2,740,517 | 4/1956 | Evans | 206/373 |
| 3,294,273 | 12/1966 | Ettlinger | 220/23.83 |
| 4,720,021 | 1/1988 | Byrns | 220/94 |
| 4,928,823 | 5/1990 | Campbell | 224/679 |
| 4,953,764 | 9/1990 | Kovacs | 224/151 |
| 5,181,637 | 1/1993 | Santilli | 224/196 |
| 5,501,499 | 3/1996 | Zitka | 294/159 |

FOREIGN PATENT DOCUMENTS

| | | | |
|---|---|---|---|
| 1124724 | 10/1956 | France | 294/159 |
| 3702061 | 8/1987 | Germany | 206/372 |
| 0008594 | of 1897 | United Kingdom | 294/159 |

*Primary Examiner*—Linda J. Sholl
*Attorney, Agent, or Firm*—Alvin S. Blum

[57] ABSTRACT

A tote tray with a carrying handle has a number of openings in its upper surface. Held securely within each opening is a rigid receptacle having an open top and closed sides and bottom. A belt clip is connected along one side so that the receptacle can be clipped to the belt for a worker to carry about a readily available supply of small items such as fasteners on the job. A supply of various styles and sizes of small items is conveniently carried to the job site in the tote tray, and whatever is needed is then clipped to the belt for as long as required. The tote tray is supplied with a belt clip engaging element adjacent each opening. The belt clip is springably engaged thereto when the receptacle is inserted into the opening. This provides more secure holding of the receptacle in the tray. The clip engaging element is arranged to position the clip along an outer vertical side of the tray so that the receptacle may be more easily grasped by the clip to keep the fingers away from contact with the items in the receptacle.

14 Claims, 1 Drawing Sheet

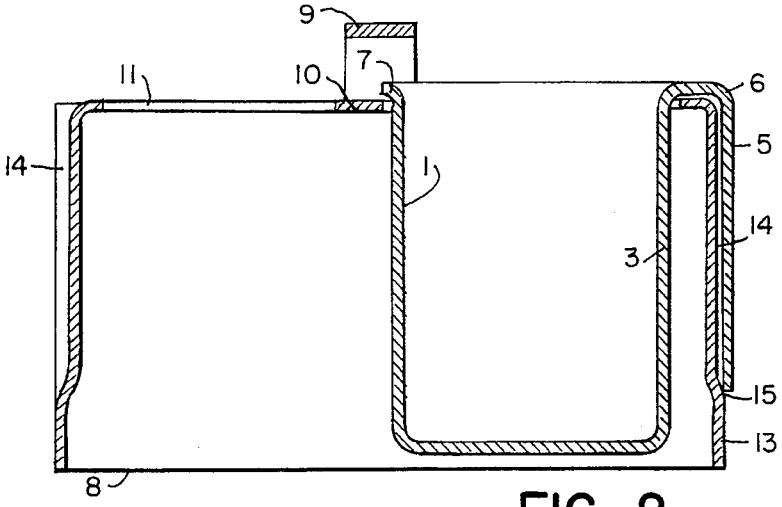
FIG. 2
FIG. 3
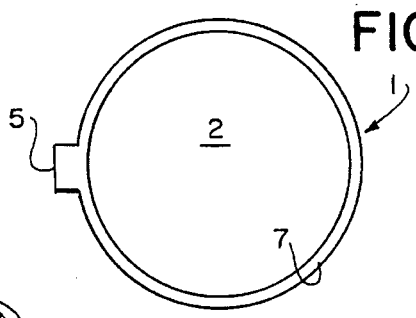
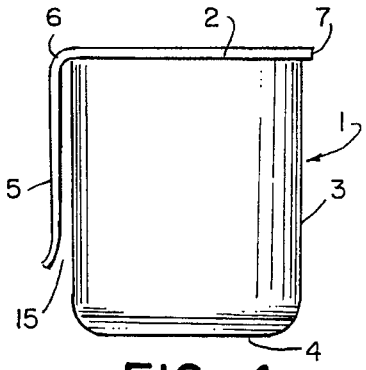
FIG. 4
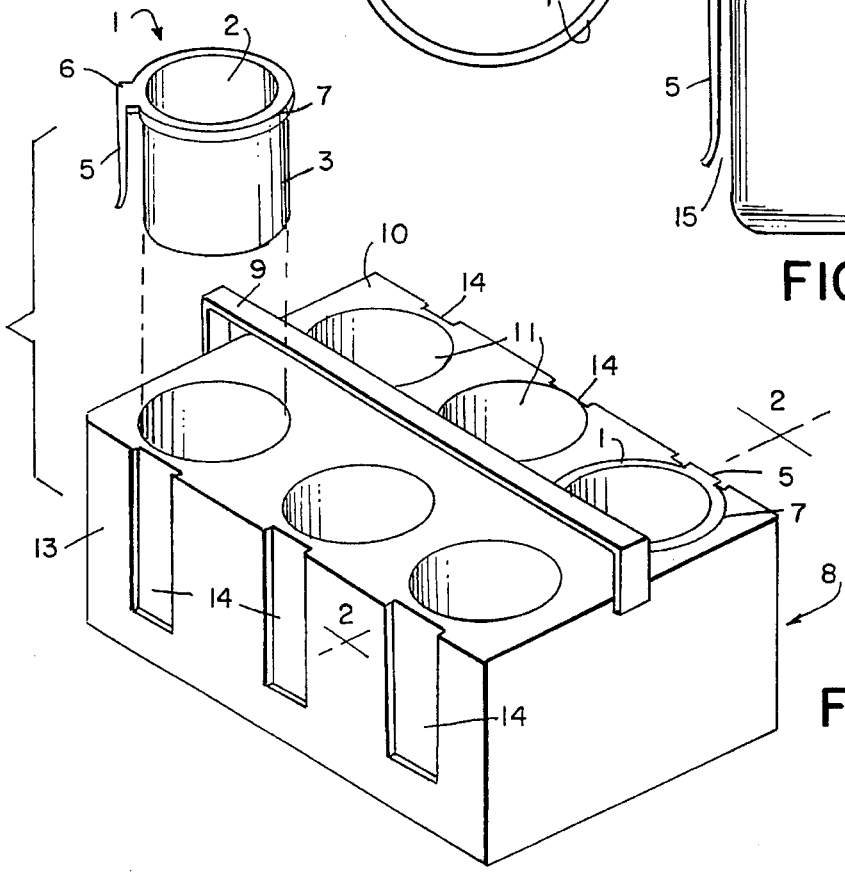
FIG. 1

BELT-MOUNTED RECEPTACLES AND TOTE TRAY THEREFOR

BACKGROUND OF THE INVENTION

This invention relates to receptacles to hold small items and more particularly to such receptacles that clip onto a worker's belt and a tote tray to hold a plurality of such receptacles.

In certain occupations, a worker must carry about a supply of a particular small item and install the items at various locations. For example, a carpenter must carry a supply of nails and hammer them into wood at selected sites on the work. A drywall installer must carry a supply of screws to drive in along the edges of the panels. In certain cases, different sizes of nails, screws, washers and the like may be required at different times during a task. It is often awkward and inconvenient to carry about a variety of items in their original containers and reach in for a screw or a nail every time one is needed.

There are fabric waistbands available with multiple compartments which can be used for this purpose, such as carpenter's aprons. Because the top openings are not easily accessed, they slow down the worker. They also put an unnecessary load on the worker when only one compartment may be required for a considerable period of time.

SUMMARY OF THE INVENTION

It is, accordingly, an object of the invention to provide for a worker a means for carrying about a supply of small items of more than one variety that is readily accessible without interfering with the worker's operations. The invention comprises a plurality of rigid receptacles. Each receptacle has an open top and a closed bottom and sides. A belt clip is attached to the receptacle and extends downwardly along one side. The receptacle can be loaded with a supply of one kind or size of an item such as screws or nails. The receptacle is clipped onto the belt. The items are then readily available to the worker, while leaving both hands free. In combination with a plurality of these receptacles, the invention comprises a tote tray with a handle and a plurality of recesses shaped so that each recess securely holds one receptacle. This enables the worker to carry about a good supply of the necessary items of various types and sizes to complete a task. This invention may be used in conjunction with a carpenter's apron in which the large supply of most used items are carried.

These and other objects, features and advantages of the invention will become more apparent when the detailed description is studied in conjunction with the drawings.

BRIEF DESCRIPTION OF THE DRAWINGS

FIG. 1 is a perspective view of the tote tray with one receptacle in place and one above the tray.

FIG. 2 is a sectional view taken through line 2—2 of FIG. 1.

FIG. 3 is a top view of the receptacle.

FIG. 4 is a side elevation view of the receptacle.

DETAILED DESCRIPTION OF THE PREFERRED EMBODIMENT

Referring now to the figures, the invention comprises a plurality of rigid receptacles 1, arranged to hold a supply of small items such as fasteners. Each receptacle has a horizontal open top 2 for easy access to the contents. The receptacle may have many shapes, but the cylindrical shape shown is preferred. It has closed vertical sides 3 and a closed bottom 4. Each receptacle 1 is provided with only one belt clip 5. The belt clip 5 is attached at its upper end 6 to the receptacle and extends downward therefrom so that it may be readily clipped onto a belt from the open end 15 of the clip without having to remove the belt.

A supply of the receptacles, loaded with small items of various styles and sizes may be carried to the work site in the tote tray 8 which as vertical sidewalls 13, and planar upper horizontal surface 10. The upper surface 10 is provided with a plurality of openings 11 having a size and shape to closely correspond to the outline of a receptacle to receive the receptacles 1. The receptacles may be provided with a rim 7 which extends radially from the top and arranged to rest upon the upper surface 10 of the tray 8 to hold the receptacle in place.

The sidewall 13 of the tray may also be provided with the vertically extending recesses 14 over which belt clips 5 pass. This forms a belt clip engaging means to which the belt clip 5 of the receptacle is springably engaged when the receptacle is received in an opening. This enhances the stability of the combination to prevent capsizing and spilling of the contents and presents a convenient handle for lifting the receptacle from the tray. A carrying handle 9 extends over the upper surface of the tote tray 8 to provide for a well balanced means of carrying the supply of receptacles about. The tray may be rested upon a horizontal support surface at the work site. As a need arises for a supply of a particular item, the receptacle holding those items is lifted from the tray and snapped onto the belt where it provides convenient access for as long as needed.

It may be safely lifted by grasping the belt clip 5 positioned along an outer vertical side of the tray 8 while avoiding contact with sharp items within the receptacle.

The above disclosed invention has a number of particular features which should preferably be employed in combination although each is useful separately without departure from the scope of the invention. While I have shown and described the preferred embodiments of my invention, it will be understood that the invention my be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. The combination of belt-mounted receptacles for carrying about supplies of small items and a tote tray therefor comprising:

(A) a plurality of rigid receptacles, each receptacle having an open, horizontal top, closed, substantially vertical sides, a closed bottom, and only one belt clip attached at an upper end thereof to said receptacle at only one location and extending downward closely adjacent to a vertical side exterior to said receptacle; and (B) a tote tray having a planar horizontal upper surface supplied with more than two openings, one for each receptacle, each opening of a size and shape to closely correspond to a receptacle outline to receive therein only one of said receptacles with sufficient security to prevent capsizing of said receptacle, said tray having a carrying handle attached thereto and extending over said upper surface for stable carrying, said tray arranged to rest with stability upon a supporting surface when loaded with said receptacles when said receptacles are loaded with small items.

2. The combination according to claim 1, in which said receptacles have a substantially cylindrical shape.

3. The combination according to claim 2, in which each of said receptacles is provided with a circumferential rim extending radially outward from said top and arranged to cooperate with said upper surface of said tote tray to support said receptacle thereon.

4. The combination according to claim 3, further comprising a plurality of clip-engaging means on said tote tray, each of said clip-engaging means disposed adjacent one of said openings and arranged to engage only one of said belt clips when a receptacle attached thereto is received in said opening for enhanced stability.

5. The combination according to claim 4, in which said tote tray has vertical sidewalls and each clip-engaging means is located in a recess in a sidewall.

6. The combination according to claim 2, further comprising a plurality of clip-engaging means on said tote tray, each of said clip-engaging means disposed adjacent one of said openings and arranged to engage only one of said belt clips when a receptacle attached thereto is received in said opening for enhanced stability.

7. The combination according to claim 6, in which said tote tray has vertical sidewalls and each clip-engaging means is located in a recess in a sidewall.

8. The combination according to claim 1, in which each of said receptacles is provided with a circumferential rim extending radially outward from said top to cooperate with said upper surface of said tote tray to support said receptacle thereon.

9. The combination according to claim 8, further comprising a plurality of clip-engaging means on said tote tray, each of said clip-engaging means being disposed adjacent one of said openings and arranged to engage only one of said belt clips when a receptacle attached thereto is received in said opening for enhanced stability.

10. The combination according to claim 9, in which said tote tray has vertical sidewalls and each clip-engaging means is located in a recess in a sidewall.

11. The combination according to claim 1, further comprising a plurality of clip-engaging means on said tote tray, each of said clip-engaging means disposed adjacent one of said openings and arranged to engage only one of said belt clips when a receptacle attached thereto is received in said opening for enhanced stability.

12. the combination according to claim 11, in which said tote tray has vertical sidewalls and each clip-engaging means is located in a recess in a sidewall.

13. The combination of belt-mounted receptacles for carrying about supplies of small items an a tote tray therefor comprising:

(A) a plurality of rigid receptacles, each receptacle having an open, horizontal top, closed, substantially vertical sides, a closed bottom, and only one belt clip attached at an upper end thereof to said receptacle at only one location and extending downward closely adjacent to a vertical side exterior to said receptacle;

(B) a tote tray having a planar horizontal upper surface supplied with a plurality of more than two openings, one for each receptacle, each opening of a size and shape to closely correspond to a receptacle outline to receive therein only one of said receptacles with sufficient security to prevent capsizing of said receptacle, said tray having a carrying handle attached thereto and extending over said upper surface for stable carrying, said tray arranged to rest with stability upon a supporting surface when loaded with said receptacles when said receptacles are loaded with small items; and (C) a plurality of clip-engaging means on said tote tray, each of said clip-engaging means disposed adjacent one of said openings and arranged to springably engage one of the belt clips when a receptacle attached thereto is received in said opening for enhanced stability, and to position the belt clip along an outer side of the tray for safely grasping the receptacle by the belt clip to avoid contact with items within the receptacle.

14. The combination according to claim 13, in which each of said receptacles is provided with a circumferential rim extending radially outward from said top and arranged to cooperate with said upper surface of said tote tray to support said receptacle thereon.

* * * * *